US005281086A

United States Patent [19]

Wissmann et al.

[11] Patent Number: 5,281,086

[45] Date of Patent: Jan. 25, 1994

[54] PUMP FOR VISCOUS FLUIDS

[75] Inventors: Michael Wissmann, Mettmann; Hans Nickel, Cottenweiler; Roland Schierling, Affalterbach; Werner Geyer, Waiblingen, all of Fed. Rep. of Germany

[73] Assignee: Andreas Stihl, Waiblingen, Fed. Rep. of Germany

[21] Appl. No.: 943,040

[22] Filed: Sep. 10, 1992

[30] Foreign Application Priority Data

Sep. 11, 1991 [DE] Fed. Rep. of Germany ... 9111278[U]

[51] Int. Cl.[5] ..... F04D 3/02; F04D 29/02

[52] U.S. Cl. ..... 415/72; 415/73; 415/90; 415/170.1; 415/197; 415/200; 416/177

[58] Field of Search ..... 415/72, 73, 90, 170.1, 415/197, 200; 417/424.1; 416/177

[56] References Cited

U.S. PATENT DOCUMENTS 4,270,882 6/1981 Luijten et al. ..... 415/72

4,684,317 8/1987 Luijten et al. ..... 415/90 X

*Primary Examiner*—Edward K. Look

*Assistant Examiner*—Michael S. Lee

*Attorney, Agent, or Firm*—Walter Ottesen

[57] ABSTRACT

The invention is directed to a pump for pumping a viscous fluid. The pump includes a stator body and a rotor body rotatably mounted in the stator body so as to be coaxial therewith. The stator body has a wall structure having a spiral slot formed therein which communicates with a suction connection formed in the stator body for conducting the viscous fluid to be pumped into the slot. A pressure connection is formed in the stator body for conducting the viscous fluid out of the slot. The suction connection and the pressure connection open into respective peripheral annular slots which are formed between a total of at least three sealing rings on the outer surface of the stator body. The channels for liquids provided in a housing can be disposed in any rotational position relative to the stator. This affords the advantage that the pump stator can be seated with any rotational position in a receiving cylinder of the housing. The sealing rings are injection molded on the stator body to define a tight seat in the receiving cylinder of the housing without additional seals. By a simple insertion of the pump rotor, a connection between the connections of the pump and the channels in the housing is provided which is tight with respect to the medium under pressure.

12 Claims, 3 Drawing Sheets

PUMP FOR VISCOUS FLUIDS

FIELD OF THE INVENTION

The invention relates to a pump for viscous fluids especially for lubricating oil in internal combustion engines of portable handheld work apparatus such as motor-driven chain saws or the like.

BACKGROUND OF THE INVENTION

One such simple and cost-effective pump which is both functionally reliable and has a long service life is advantageously used as a lubricating pump in two-stroke engines especially two-stroke injection engines for portable handheld work apparatus such as motor-driven chain saws. The oil pump is used to provide separate lubrication to supply the piston path, the bearing it catera with lubricating oil. Such a pump is also advantageous for supplying lubricating oil for the saw chain of a motor-driven chain saw.

A connection between the suction connection and the pressure connection of the pump and other channels for conducting the lubricating oil must be provided when building a pump of this kind into the housing of a work apparatus. The connection must be tight with respect to the medium under pressure. For this purpose, appropriate sealing rings are mounted in the housing or on the stator of the pump which is both time and work intensive.

SUMMARY OF THE INVENTION

It is an object of the invention to provide a pump of the kind described above which is improved in that a connection of the pump to the channels in the housing of the work apparatus is made possible in a simple and time-saving manner with this connection being seal-tight as to the medium under pressure.

The pump of the invention is for pumping a viscous fluid and includes: a stator body having a longitudinal axis; a rotor body having a longitudinal axis and being rotatably mounted in the stator body so as to be coaxial therewith; the stator body having an inner wall surface and the rotor having an outer wall surface facing toward the inner wall surface; the wall surfaces conjointly defining a surface interface therebetween; one of the bodies having a wall structure defining the wall surface corresponding thereto; the wall structure being made of elastomeric material and having a spiral slot formed therein; the spiral slot having first and second ends; suction connection means formed in the stator body so as to communicate with the first end for conducting the viscous fluid to be pumped into the slot; pressure connection means formed in the stator body so as to communicate with the second end for conducting the viscous fluid out of the slot; the stator body having an outer wall surface configured to have at least three sealing rings injection molded thereon; the sealing rings being made of elastomeric material; a first two of the sealing rings defining a first annular slot on the outer wall surface of the stator body and a second two of the sealing rings defining a second annular slot on the outer wall surface of the stator; and, the suction connection means extending through the stator body so as to communicate with the first annular slot and the pressure connection means extending through the stator body so as to communicate with the second annular slot.

The suction connection and the pressure connection first open into respective peripheral annular slots which are formed between a total of at least three sealing rings. For this reason, the channel for liquids provided in the housing can be disposed in any rotational position relative to the stator. This affords the advantage that the pump stator can be seated with any rotational position into the receiving cylinder of the housing. The sealing rings injection molded on the stator define a tight seat in the receiving cylinder of the housing without additional sealing means. By a simple insertion of the pump rotor, a connection between the connections of the pump and the channels in the housing is provided which is tight with respect to the medium under pressure.

According to a feature of the invention, the stator has a stepped diameter whereby a simplified assembly and protection of the sealing rings against damage during assembly is provided.

According to another feature of the invention, the stator is configured as an elastomeric body which is injection-molded as one piece with the wall structure defining the spiral slot and the sealing rings arranged on the outer surface thereof. With the manufacture of the stator, all sealing rings are formed which are necessary for an assembly of the stator in the receiving cylinder of the housing. The annular seals on the elastomeric body which close the spiral slot with respect to the ambient are also injection molded on the bodies so that the tight seat of the rotor in the stator is ensured without additional measures. One element of the pump is simply inserted into the other element and the pump is operational. The stator together with the rotor is axially inserted into the receiving cylinder of the housing whereby the connection of the pump to the channels in the housing is simultaneously produced with this connection being seal-tight with respect to the medium under pressure.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
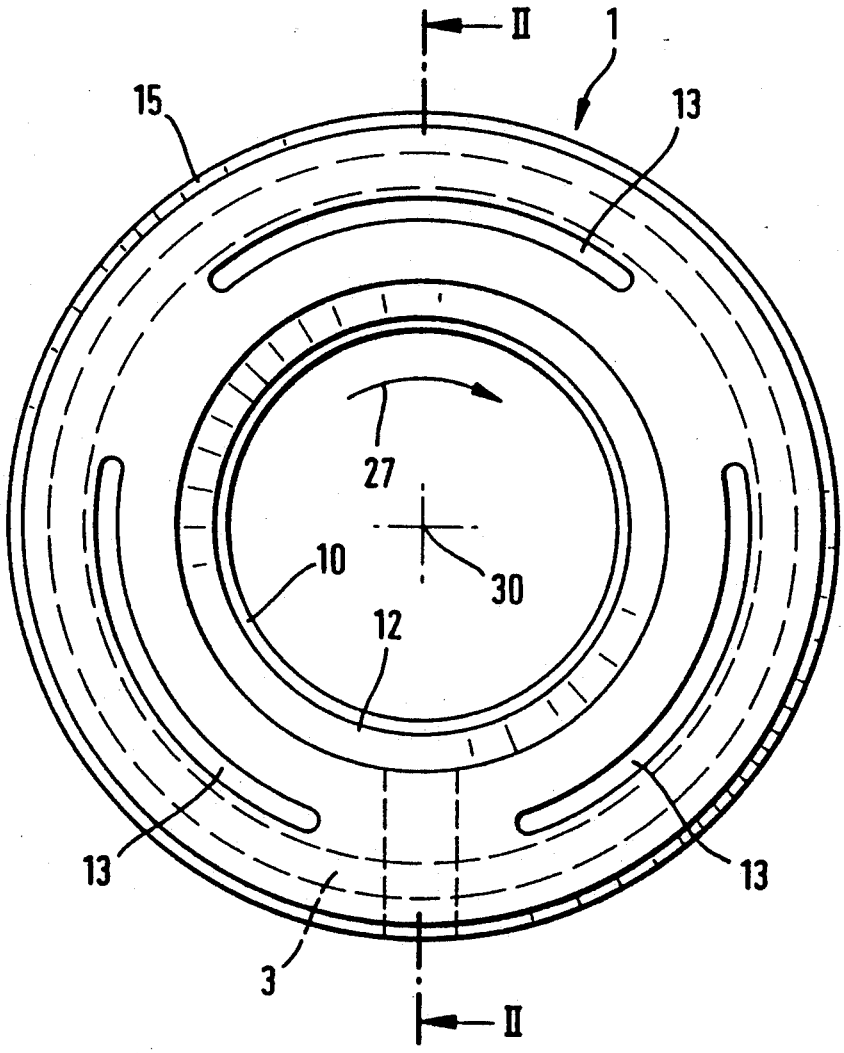
FIG. 1 is an elevation view of the end face of the stator of a pump according to the invention viewed in the direction of arrow I of FIG. 2.

The stator 1 of a pump comprises an elastomeric body 2 which is injection molded onto a rigid carrier 3 for increasing form stability. The carrier 3 is essentially completely embedded in the elastomeric body 2 and comprises a tubular section coaxial to the longitudinal axis of the pump. The tubular section is preferably made of steel.

The tubular-shaped elastomeric body 2 has an inner jacket defining a wall section 4 into which a screw-like spiral slot 5 is formed. The spiral slot 5 opens at one end into a collecting channel 6 configured as an annular slot and opens at the other end into a collecting channel 7 also configured as an annular slot. The collecting channel 6 communicates with a suction connection 8 and the collection channel 7 communicates with a pressure connection 9. Suction connection 8 and pressure connection 9 are through bores configured radially in the body 2 and in the carrier 3.

The collection channel 6 is an in-flow slot and the collection channel 7 is an out-flow slot. The inflow slot and the outflow slot are sealed off at respective axial ends of the stator 1 by respective annular seals 10 and 11. At one end, the body 2 further includes a ring-shaped seal 12.

Figure 2:
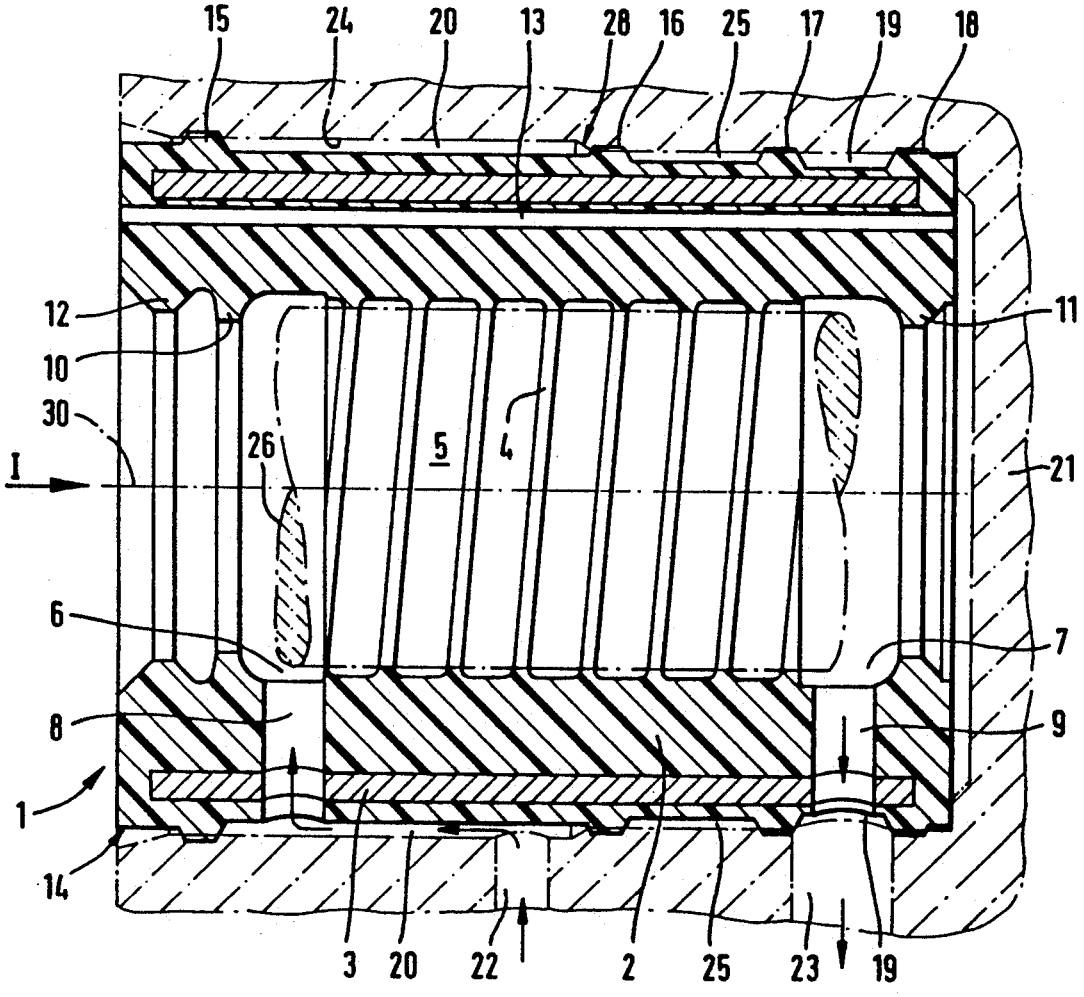
FIG. 2 is a section view taken along line II—II of the pump of FIG. 1.

To increase the radial elasticity, at least one hollow space 13 is provided between the rigid carrier 3 and the inner jacket of the stator 1. As shown in FIGS. 1 and 2, the hollow space 13 is defined by an annularly shaped slot which extends approximately 90° in the peripheral direction of the stator and runs essentially from one axial end of the stator to the other axial end thereof. It can be advantageous to allow the hollow space to remain open at one or both axial ends of the stator 1.

As shown in FIG. 1, three hollow spaces 13 are distributed uniformly over the periphery of the stator 1.

Peripheral sealing rings 15 to 18 are injection molded on the outer jacket 14 of the elastomeric body 2 defining the stator. The sealing rings delimit annular slots 19 and 20 with the suction connection 8 opening into the annular slot 20 and the pressure connection 9 opening into the annular slot 19.

The axial spacing of the sealing rings 15 and 16 for delimiting the annular slot 20 and the sealing rings 17 and 18 for delimiting the annular slot 19 are so selected that the suction channel 22 and pressure channel 23, respectively, are in flow connection with the suction connection 8 and the pressure connection 9, respectively. The suction channel 22 and the pressure channel 23 are formed in the housing 21 of a work apparatus such as a motor-driven chain saw or the like.

The annular slots 19 and 20 are formed on the outer jacket by the sealing rings 15 to 18 injection molded thereon and therefore have the function of connecting channels. It is advantageous that the stator can be inserted into the receiving cylinder 24 in any rotational position since the annular slots 19 and 20 guarantee a connection between the suction and pressure connections and the channels in every rotational position. Only the axial spacing of the channels 22 and 23 with reference to the axial end position of the stator 1 must be considered. Correspondingly, the sealing rings 15 to 18 are mounted with axial spacing on the outer jacket 14 of the stator 1.

An annular slot 25 is additionally formed between the sealing rings 16 and 17 in the embodiment shown. This annular slot 25 guarantees a further separation of the annular slot 19 of the pressure region from the annular slot 20 of the suction region. However, three sealing rings are adequate.

The elastomeric body 2 is formed as one piece on the carrier 3 with the following: the wall 4 having the spiral slot, the inner annular seals or sealing rings 10 and 11, an inner dirt-deflecting lip 12 disposed preferably at the outer end and the sealing rings 15 to 18 arranged on the outer wall surface 14.

For assembling the pump in the housing 21, the stator 1 is simply inserted axially into the receiving cylinder 24 of the housing 21 with the sealing rings 15 to 18 establishing the necessary seals. The stator 1 must now only be secured axially in the receiving cylinder 24. To simplify assembly and for obtaining protection of the sealing lips during assembly, the stator 1 is configured to have a stepped outer diameter and the receiving cylinder 24 in the housing 21 is configured with a corresponding diameter step 28. A symmetrical configuration of the stator 1 without the diameter step can be advantageously provided so that the stator 1 can be mounted in advance with one of its axial ends independently of position.

The rotor is configured as a smooth shaft 26 and is likewise axially inserted into the stator. All necessary sealing measures are established simultaneously because of the seals formed by injection molding.

When the shaft 26 is rotated in the rotational direction 27, the viscous liquid is pumped and is preferably lubricating oil and adheres to the shaft surface. Because the wall section 4 has a screw-like spiral slot formed therein, the viscous liquid is taken along to the pressure connection 9. The quantity conveyed by a pump of this kind is very small and is approximately in the order of magnitude of 20 $cm^3$ per hour. The spiral slot formed in this manner has a width which is a multiple greater than its height. The dimensions of the slot are between several tenths to hundredths of a millimeter. The spiral slot 5 is provided with more or less turns to change the conveying pressure. If the amount to be conveyed is to be varied, then this can be achieved by changing the depth and the width of the slot. The speed of the rotor is also to be considered in this context. It is essential that the conveyed or pumped quantity and the conveying pressure can be adjusted independently of each other and a pump quantity proportional to rotational speed is present.

Figure 3:
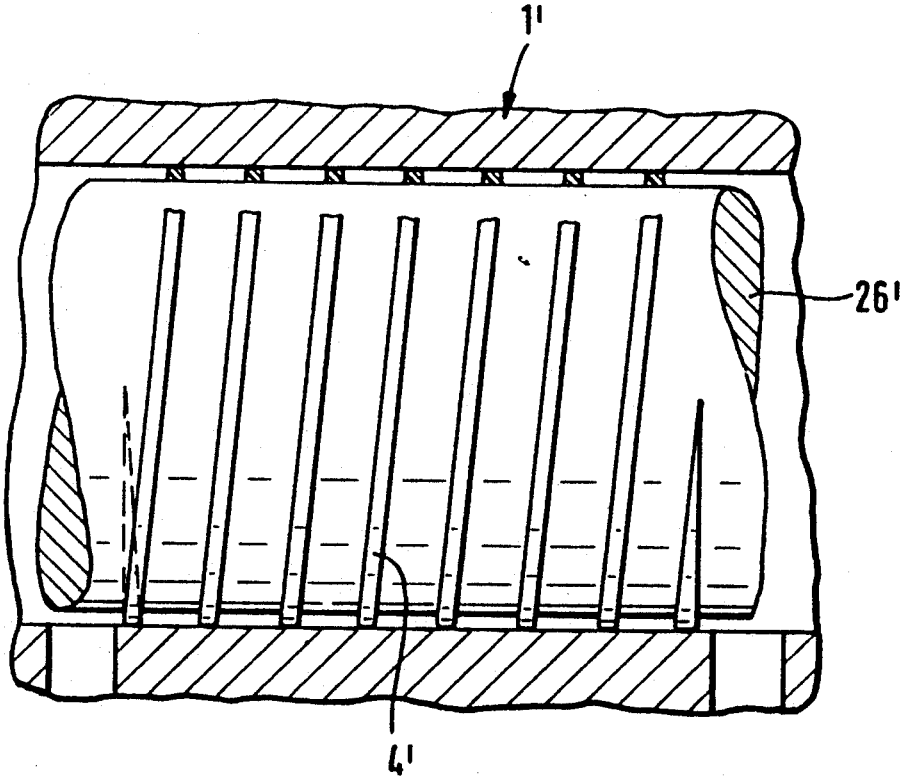
FIG. 3 is a section view of another embodiment of the pump according to the invention wherein the stator is made of metal and the rotor is provided with a wall structure made of elastomeric material.

FIG. 3 is another embodiment of the pump of the invention wherein the stator 1' is made of metal and a rotor 26' is rotatably mounted therein. The rotor 26' is provided with a wall structure 4' made of elastomeric material and defining a spiral slot having first and second ends as shown.

It is understood that the foregoing description is that of the preferred embodiments of the invention and that various changes and modifications may be made thereto without departing from the spirit and scope of the invention as defined in the appended claims.

What is claimed is:

1. A pump for pumping a viscous fluid, the pump comprising:

a stator body having a longitudinal axis;

a rotor body having a longitudinal axis and being rotatably mounted in said stator body so as to be coaxial therewith;

said stator body having an inner wall surface and said rotor having an outer wall surface facing toward said inner wall surface;

said wall surfaces conjointly defining a surface interface therebetween;

one of said bodies having a wall structure defining the wall surface corresponding thereto;

said wall structure being made of elastomeric material and having a spiral slot formed therein;

said spiral slot having first and second ends;

suction connection means formed in said stator body so as to communicate with said first end for conducting the viscous fluid to be pumped into said slot;

pressure connection means formed in said stator body so as to communicate with said second end for conducting the viscous fluid out of said slot;

said stator body having an outer wall surface configured to have at least three sealing rings injection molded thereon;

said sealing rings being made of elastomeric material;

a first two of said sealing rings defining a first annular slot on said outer wall surface of said stator body and a second two of said sealing rings defining a second annular slot on said outer wall surface of said stator body; and, said suction connection means extending through said stator so as to communicate with said first annular slot and said pressure connection means extending through said stator body so as to communicate with said second annular slot.

2. The pump of claim 1, said outer wall surface of said stator body being configured so as to have a stepped diameter.

3. The pump of claim 1, said stator body being an elastomeric body incorporating said wall structure therein, said elastomeric body, said spiral slot and said sealing rings being made as a single injection-molded piece.

4. The pump of claim 3, one of said first two sealing rings and one of said second two sealing rings conjointly defining a third annular slot separating said first and second annular slots from each other.

5. The pump of claim 4, said elastomeric body including a reinforcement carrier embedded therein.

6. The pump of claim 5, said reinforcement carrier being a tubular section made of metal.

7. The pump of claim 6, said metal being steel.

8. The pump of claim 5, said single injection-molded piece including at least one hollow space formed therein between said carrier and said wall structure.

9. The pump of claim 5, said hollow space extending over the axial length of said stator body.

10. The pump of claim 1, further comprising annular seals injection molded onto said inner wall surface of said stator body for closing off said spiral slot from the outside environment.

11. The pump of claim 10, further comprising a first collection channel disposed between said first annular seal and said first end of said spiral slot; and, a second collection channel disposed between said second annular seal and said second end of said spiral slot.

12. The pump of claim 1, said stator body having an axial outer end and said pump further comprising an inner dirt deflecting seal formed as a single piece with said stator body.

* * * * *